US005670926A

United States Patent [19]

Ranjan et al.

[11] Patent Number: 5,670,926

[45] Date of Patent: Sep. 23, 1997

[54] HIGH-VOLTAGE FUSE HAVING A CORE OF BOUND SILICA SAND ABOUT WHICH FUSIBLE ELEMENTS ARE WOUND

[75] Inventors: Radhakrishnan Ranjan, Hickory; Richard Francis Shoestock, Sr., Lenoir, both of N.C.

[73] Assignee: General Electric Company, New York, N.Y.

[21] Appl. No.: 482,232

[22] Filed: Jun. 8, 1995

[51] Int. Cl.[6] ..... H01H 85/04

[52] U.S. Cl. ..... 337/158; 337/252; 337/279

[58] Field of Search ..... 337/158–160, 337/273, 279, 252; 29/623

[56] References Cited

U.S. PATENT DOCUMENTS

| | | | |
|---|---|---|---|
| 1,213,777 | 1/1917 | Roberts . | |
| 2,772,334 | 11/1956 | Latour | 200/144 |
| 3,166,656 | 1/1965 | Hollman et al. | 200/120 |
| 3,838,375 | 9/1974 | Frind et al. | 337/276 |
| 3,967,228 | 6/1976 | Koch et al. | 337/248 |
| 4,028,655 | 6/1977 | Koch | 337/160 |
| 4,544,908 | 10/1985 | Blewitt et al. | 337/279 |
| 4,686,502 | 8/1987 | Parker et al. | 337/252 |

*Primary Examiner*—Leo P. Picard
*Assistant Examiner*—Jayprakash N. Gandhi
*Attorney, Agent, or Firm*—Richard A. Menelly; Carl B. Horton

[57] ABSTRACT

This high-voltage fuse comprises a tubular housing and a fuse subassembly within the housing with a core in the form of an elongated, cylindrical body primarily of silica sand particles bound together in a rigid, porous mass, a fusible element wound about the core, and connector assemblies at opposite ends of the core electrically connected to opposite ends of the fusible element. The fuse subassembly is closely surrounded by silica sand in the space between the housing and the subassembly.

17 Claims, 2 Drawing Sheets

HIGH-VOLTAGE FUSE HAVING A CORE OF BOUND SILICA SAND ABOUT WHICH FUSIBLE ELEMENTS ARE WOUND

FIELD OF THE INVENTION

This invention relates to a high-voltage fuse and, more particularly, to a high-voltage fuse that comprises an elongated core and one or more fusible elements wound about the core.

BACKGROUND

A typical high-voltage, current-limiting fuse comprises a tubular insulating housing, an elongated core within the housing, and one of more fusible elements wound about the core and connected between terminals at opposite ends of the housing. A core is needed in fuses of this type rated at 5 KV and above in order to enable the fuse to accommodate the required length of fusible element within a housing of practical length. Housing lengths may range from 8 to 38 or more inches. By winding the fusible elements(s) about the core, preferably in generally helical path(s), fuses having fusible elements of a length much greater than the length of the core can be produced.

In prior high-voltage fuses, the cores are typically made of mica, or of a ceramic material that may or may not have gas-evolving properties. These cores typically have a transverse cross-section in the shape of a star, i.e., with a centrally-located trunk and a plurality of legs projecting from the trunk, with recesses between the legs, as is illustrated, for example, in U.S. Pat.4,028,655—Koch et al. One reason for using this core configuration is so as to lengthen the creepage distances along the core surface between the turns of the fusible element(s). In the manufacture of such fuses, the fusible elements are helically wound about the star-shaped core, and the resulting assembly is inserted into the tubular housing. The housing is then filled with particulate matter, typically silica sand, which is densely packed about the core-fusible element assembly and also in the recesses between the core legs and the fusible elements. To assist in packing the sand with the desired high degree of density, the fuse is typically vibrated during and after being filled with the sand. The star shape of the core makes it difficult to achieve the desired high density of the fill since vibration for a long period of time is needed to achieve a dense pack of sand in the recesses between the core legs and the fusible elements.

The performances of such a fuse depends upon the sand fill being held in close proximity to the location of the fusible elements since the arc or arcs formed upon operation of the fuse need to quickly react with and to be effectively constricted by the surrounding sand in order for the fuse to effect the desired current-limiting action. In the typical prior art fuse, this close proximity between the sand and the fusible element(s) is achieved by densely packing with sand the otherwise vacant spaces about the fusible element(s), including the recesses between the core legs. In view of the difficulties involved in packing these recesses with the sand fill, it would be highly desirable if the close proximity required between the sand and the fusible elements(s) could be achieved without the need for providing such recesses in the core for receiving the sand fill.

SUMMARY

In carrying out the invention in one form, we make the fuse core itself of a material that is primarily silica sand, the particles of which are bonded together to form a rigid mass. Before the core is formed, the silica sand that is subsequently used for the core is mixed with bonding agents, preferably kaolin clay and colloidal silica or a sodium silicate solution. The resulting mixture is suitably shaped, following which it is baked into a rigid mass of elongated configuration that is used for the core. Connector assembles are provided at opposite ends of the elongated rigid mass, and one or more fusible elements are wound about the mass and connected between the connector assemblies.

In one form of the invention, the rigid mass forming the core is of cylindrical shape and has a substantially circular transverse cross-section. The helically-wound fusible element closely surrounds the periphery of the circular cross-sectional core. In one embodiment, the core has a periphery that is generally smooth apart from the roughness resulting from the presence of projecting silica sand particles; and in another embodiment, the core periphery has helical indentations in which the fusible element is seated.

BRIEF DESCRIPTION OF FIGURES

For a better understanding of the invention, reference may be had to the following detailed description taken in connection with the accompanying drawings, in which.

DETAILED DESCRIPTION OF EMBODIMENTS

Figure 1:
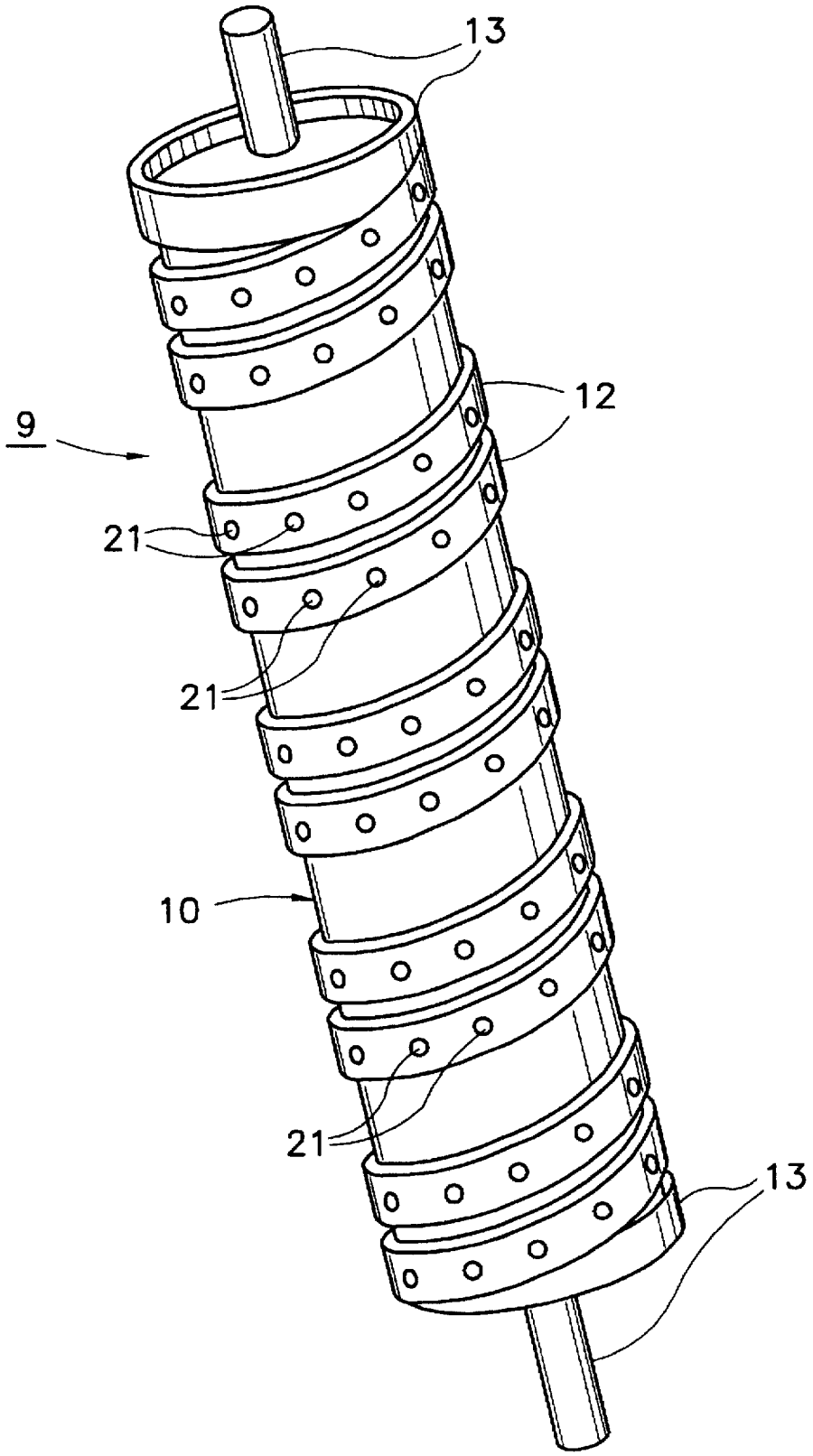
FIG. 1 is a perspective view of a core-fusible element subassembly embodying one form of our invention.

The subassembly 9 of FIG. 1 comprises an elongated core 10 of an electrical insulating material soon to be described, two fusible elements 12 helically wound about the core, and conductive connector assemblies 13 fixed to the core at its opposite ends. The fusible elements 12 are electrically connected at their opposite ends to the connector assemblies 13 by suitable means such as soldered or welded joints. A completed fuse includes an outer tubular casing, shown at 16 in FIG. 2, that encases the subassembly of FIG. 1 and fill 18 of particulate matter (soon to be described) occupying the space between the subassembly 9 and the casing 16. The completed fuse also includes conductive terminals 20 mounted on opposite ends of the tubular casing 16 and suitably electrically connected to the connector assemblies adjacent the respective terminals.

The fill 18 in the space between the subassembly 9 and the outer tubular casing 16 is of particulate matter, e.g. silica sand. If the fill is of silica sand, it can be either a densely packed sand with no bonding between its particles or a sand with its particles bonded together, e.g., in the manner disclosed in U.S. Pat. Nos. 3,838,375—Frind et al or U.S. Pat. No. 3,967,228—Koch et al.

In one embodiment of the invention, the core 10 is made of a mixture including as its primary constituent pure silica sand of the type conventionally used in the fill of current-limiting fuses, and, to a much lesser extent, finer grain silica filler, kaolin clay, and a binder of colloidal silica or a sodium silicate solution. If a sodium silicate solution is used, the solvent may be either water, kerosene, ether, or some other suitable liquid. In one specific form of the invention, the following mixture can be used to make a 1 inch diameter cylindrical core 15 inches in length.

Pure silica sand 400 grams
Fine grain silica 50 grams
Kaolin clay 50 grams
Colloidal silica 80cc After these components are thoroughly mixed together, the resulting wet mixture is introduced into a sand core box having a mold cavity corresponding to the desired cylindrical shape of the core, the annular connector assemblies 13 having previously been disposed at opposite ends of the mold cavity. The introduced mixture fills the mold cavity and the annular connector assemblies 13, forming a cylindrically shaped green core on the ends of which the connector assemblies are mounted. The resulting core assembly is then air dried, following which it is baked at an appropriate temperature (e.g., about 140° C) for 4 to 6 hours to covert the green core into a rigid mass in the shape of the cylindrical fuse core 10 having the connector assemblies 13 bonded to its opposite ends. While a molding process such as described hereinabove is one way of forming the fuse core, other processes are also suitable, such as extrusion. In such a process a wet mixture corresponding to the above-described mixture is extruded through a suitably shaped die to produce a long extrusion of the desired transverse cross-section. The long extrusion is then cut to the desired length to form the core element, following which the end connector assemblies 13 are applied to the core element. Then this subassembly is air dried and then baked to convert the core element into a rigid mass having the end connector assemblies in place.

Figure 2:
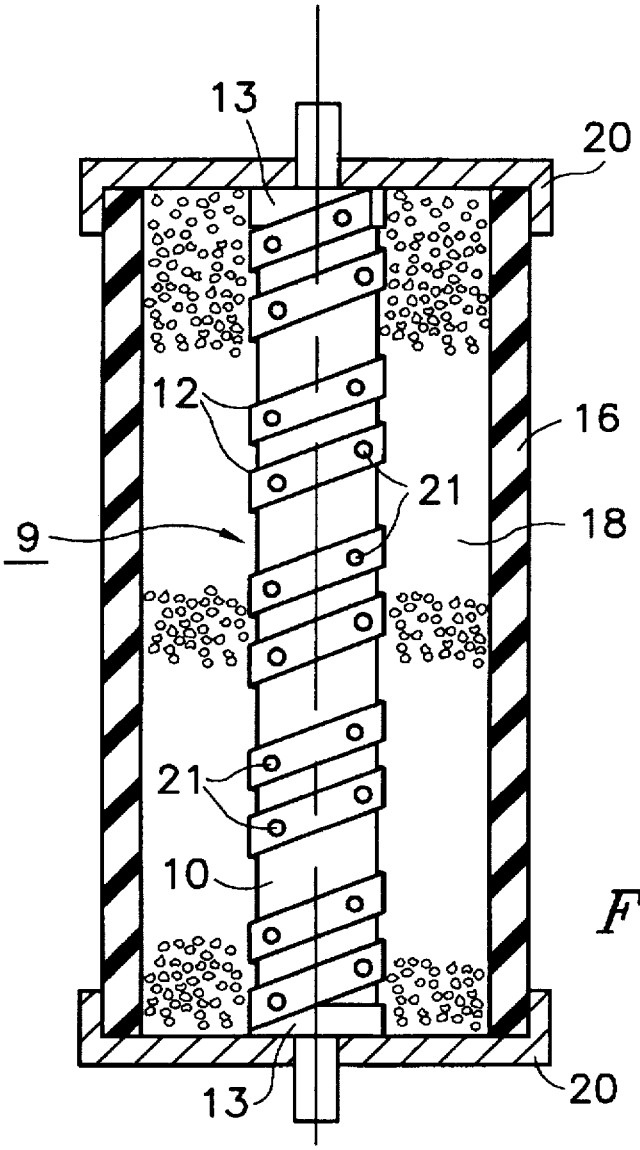
FIG. 2 is a side-elevational view, partly in section, of a fuse that includes the subassembly of FIG. 1 and a tubular casing of insulating material surrounding the subassembly.

After the core 10 (with the end connector assemblies 13 in place) is formed by one of the above processes, the fusible elements 12 are helically wound on the core and their ends attached to the end connector assemblies. In FIGS. 1 and 2 two fusible elements 12 electrically in parallel are shown wound about the core, but, depending upon the current rating of the fuse, a single fusible element or more than two elements may be used, each being helically wound about the core. The fusible elements 12 can be of a common fusible metal, such as copper, aluminum, or silver. Each of the fusible elements 12 can be of a conventional form, e.g., in the form of a ribbon, such as shown, which contains holes 21 at spaced locations along its length defining regions of reduced cross-section where an arc can be initiated in response to a fault current through the fusible element. The fusible elements can also be of wire form instead of the ribbon form shown.

The peripheral surface of the sand core, although smooth on a gross basis, has a rough texture, and this roughness assists in holding the fusible elements in place on the core against displacing forces, e.g., those developed during subsequent filling of the casing 16 with sand and also during an interrupting operation. The rough sand surface also has a high resistance to arc tracking, and this decreases the likelihood that an arc will develop on the core surface between the turns of the fusible element or elements during an interrupting operation. An arc between the turns is undesirable because it typically will short out a length of the fusible element and any additional arcs that might be present in such length.

Figure 3:
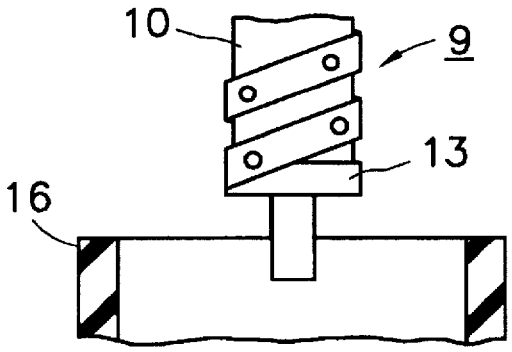
FIG. 3 shows the subassembly of FIG. 1 being assembled within the tubular casing.

After the core-fusible element subassembly 9 is produced in the above manner, it is introduced into the tubular insulating casing 16 in the manner shown in FIG. 3. One of the end terminals 20 is applied to the lower end of casing 16 and suitably connected to the lower end-connector assembly 13, following which the space between the subassembly 9 and the casing 16 is filled with particulate matter 18, such as silica sand. Thereafter, the other terminal 20 is applied to the upper end of the casing 16 and is suitably electrically connected to the upper end-connector assembly 13. If the sand fill 18 is to be of the bonded type of sand, it can be treated with suitable bonding material before being used to fill the casing 16 or it can be treated with liquid bonding material after filling the otherwise-vacant space within the casing 16. This latter treatment can be effected using one of the processes disclosed in the aforesaid Frind et al U.S. Pat No. 3,838,375 or the Koch et al U.S. Pat. No. 3,967,228. After the sand is in place, the fuse assembly is suitably heated to drive off moisture and to complete the sand-bonding process, assuming that the bonded type of sand is being used.

In the sand core composition described hereinabove the fine-grain silica sand additive acts as a filler, its particles being located between the larger particles of the major silica sand component and serving to control the porosity of the mixture. The kaolin clay acts as a bonding agent for the mixture, imparting increased mechanical strength to the core, and also contributes to the current-interrupting properties of the mixture by evolving water vapor during arcing in response to the heat of the arc. The colloidal silica is primarily a bonding agent that binds together the particles of the mixture. When the core is air-dried and baked before its introduction into the fuse, the water in the colloidal silica is evaporated. Left behind on the particles of the mixture is a thin coating of the silica from the colloidal suspension which serves to bind together these particles. This coating is so thin that it does not substantially affect the porosity of the final core.

It is to be noted that having a core of cylindrical shape makes it easier to achieve the desired intimate contact between the sand fill and the exposed surfaces of the fusible element. There are no recesses underneath the fusible element (as with the core of star configuration) that must be tightly packed in order to achieve such intimate contact.

It is to be further noted that the circular outer periphery of the core is an ideal configuration for maximizing the spacing between the turns of a helical fusible element of a given length wound on a core of a given length and diameter. With a conventional star-shaped core, the fusible element wound about the core typically follows a straight-line path in its portions spanning the recesses that are disposed between the legs of the star, thus shortening the effective circumference of the star-shaped core. To compensate for this shortening that is present with the star-shaped core, it is necessary (with a star-shaped core and a fusible element of given lengths) to locate the turns of the helically-wound fusible element closer together in order to squeeze into the fuse a helically-wound fusible element of this length.

The illustrated fuse operates in generally the same manner as conventional current-limiting fuses. That is, when an overcurrent or a fault current flows through the fusible elements, the fusible elements melt and then vaporize at preselected locations along their length, usually beginning where the holes 21 are located, causing arcs to develop at these locations. The arcs react with the surrounding sand and develop pressures in the arcing region that produce arc voltages that force the current to zero. The pressurized metallic vapors generated when the arcs vaporize portions of the fusible elements attempt to expand away from the arcing regions.

The porous character of the surrounding sand enables the expanding and hot metallic vapors to be quickly dissipated from the arcing regions, thus cooling the hot vapors, limiting the pressures built up, and thereby facilitating successful interruption. The core itself has some porosity, and this effectively contributes to rapid dissipation of the metallic vapors developed by the arcs.

While the core has some porosity, it is sufficiently hard and resistant to arc-erosion that its regions immediately adjacent the fusible element normally do not move substantially during arcing. Such movement is usually undesirable because it would allow the channel normally occupied by the fusible element to expand, and this would detract from the interrupting ability of the fuse.

Figure 4:
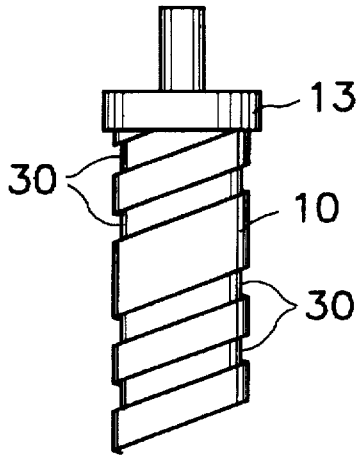
FIG. 4 shows a modified form of the fuse core.

In the modified embodiment of the invention shown in FIG. 4 the core periphery is provided with shallow indentations 30 in which the helically-wound fusible elements normally seat. These indentations are of a helical form corresponding to the helical form desired for the wound fusible elements. These indentations serve to locate the fusible elements more precisely and to hold the fusible elements against shifting along the core length when forces tending to produce such shifting are developed, as during filling of the fuse casing 16 and during interrupting operations.

While the invention has been disclosed herein with respect to certain specific embodiments and examples thereof, various modifications and changes will occur to those skilled in the art. Accordingly, it is intended to cover all such modifications and changes as fall within the true spirit and scope of the invention.

What we claim is:

1. A high-voltage fuse subassembly comprising:

(a) a core in the form of an elongated body primarily of silica sand particles bound together in a porous rigid mass having an outer peripheral surface, (b) a fusible element wound about said core after said sand particles are bound together in said porous rigid mass, said fusible element contacting said outer peripheral surface, and (c) connector assemblies at opposite ends of said core electrically connected to opposite ends of said fusible element.

2. A high-voltage fuse subassembly as defined in claim 1 wherein said core is of a generally cylindrical shape.

3. A high-voltage fuse subassembly as defined in claim 2 wherein said fusible element is helically wound on the surface of said core.

4. A high-voltage fuse subassembly as defined in claim 3 wherein the surface of said core is generally cylindrical and has indentations in which said helically-wound fusible element is positioned and held in place on said core surface.

5. A high-voltage fuse subassembly as defined in claim 1 in which:

(a) said fusible element is in the form of a first winding on said core, and (b) an additional fusible element is present in the form of a second winding on said core connected electrically in parallel with said first winding.

6. A high-voltage fuse subassembly as defined in claim 5 wherein the surface of said core is generally cylindrical and has indentations in which said fusible elements are positioned and held in place on said core surface.

7. A high-voltage fuse subassembly as defined in claim 1 wherein a substantial portion of the length of the fusible element is in contact with the peripheral surface of said core, and said peripheral surface includes projecting silica sand particles imparting to said surface a higher resistance to arc-tracking and a roughness that blocks movement of said fusible element on said core when subjected to forces along the core length developed when particulate filler is packed about the fuse subassembly during manufacture of a fuse containing said subassembly.

8. A high-voltage fuse subassembly as defined in claim 7 in which said core is of a generally cylindrical shape and is substantially free of recesses extending along the length of the core and spanned by the fusible element.

9. A high-voltage fuse subassembly as defined in claim 1 in which said core is of a material that is made from a mixture comprising silica sand as a primary constituent and, as secondary constituents, small amounts of kaolin clay and colloidal silica or a sodium silicate solution.

10. A high-voltage fuse comprising:

(a) a tubular housing, (b) a fuse subassembly within said housing comprising a core in the form of an elongated body primarily of silica sand particles bound together in a rigid, porous mass having an outer peripheral surface, a fusible element wound about the outer peripheral surface of said core, after said sand particles are bound together in said rigid, porous mass, said fusible element contacting said outer peripheral surface, and connector assemblies at opposite ends of said core electrically connected to opposite ends of said fusible element, (c) particulate matter closely surrounding said fuse subassembly, and (d) conductive terminals at opposite ends of said housing electrically connected to said connector assemblies.

11. A high-voltage fuse as defined in claim 10 wherein said core is of a generally cylindrical shape and said fusible element is helically-wound about the outer peripheral surface of said core.

12. A high-voltage fuse as defined in claim 11 wherein the outer peripheral surface of said core is of generally cylindrical shape has indentations in which said fusible element is positioned and held in place.

13. A high voltage fuse as defined in claim 10 wherein a substantial portion of the length of the fusible element is in contact with the peripheral surface of said core, and said peripheral surface includes projecting silica sand particles imparting to said surface a higher resistance to arc-tracking a roughness that blocks movement of said fusible element on said core when subjected to forces along the core length developed when said particulate filler is tightly packed about the fuse assembly during manufacture of said fuse.

14. A high-voltage fuse as defined in claim 13 in which said core is of a generally cylindrical shape and is substantially free of recesses extending along the length of the core and spanned by the fusible element.

15. A high-voltage fuse as defined in claim 10 wherein said core is of a material comprising a mixture of pure silica sand, fine grain silica, and kaolin clay.

16. A high-voltage fuse as defined in claim 15 wherein the outer peripheral surface of said core is generally cylindrical and has indentations in which said fusible element is positioned and held in place.

17. A high-voltage fuse as defined in claim 10 in which said core is of a material that is made from a mixture comprising silica sand as a primary constituent and, as secondary constituents, small amounts of kaolin clay and colloidal silica or a sodium silicate solution.

* * * * *